US006103986A

United States Patent [19]

Asakawa et al.

[11] Patent Number: 6,103,986

[45] Date of Patent: Aug. 15, 2000

[54] CIRCUIT BREAKER INCLUDING BRIDGING CONTACT WITH MAGNETIC STRUCTURE

[75] Inventors: Koji Asakawa; Takumi Fujihira; Naoshi Uchida; Katsunori Kuboyama; Tatsunori Takahashi; Kentaro Toyama, all of Saitama, Japan

[73] Assignee: Fuji Electric Co., Ltd., Kawasaki, Japan

[21] Appl. No.: 09/272,290

[22] Filed: Mar. 19, 1999

[30] Foreign Application Priority Data

Apr. 7, 1998 [JP] Japan ..... 10-111502

[51] Int. Cl.[7] ..... H01H 33/18; H01H 75/02

[52] U.S. Cl. ..... 218/22; 218/27; 218/31; 218/32; 218/36; 335/16; 335/195

[58] Field of Search ..... 218/16, 17, 18, 218/19, 20, 22, 24, 26, 30, 31, 32, 36, 40, 146, 148–149, 154–158, 27; 335/16, 147, 201, 195, 202

[56] References Cited

U.S. PATENT DOCUMENTS

| | | | |
|---|---|---|---|
| 4,132,968 | 1/1979 | Lang | 335/16 |
| 4,367,448 | 1/1983 | Nishizako | 335/201 |
| 4,743,720 | 5/1988 | Takeuchi et al. | 335/201 X |
| 5,493,091 | 2/1996 | Devautour et al. | 218/30 |
| 5,495,083 | 2/1996 | Aymami-Pala et al. | 218/1 |
| 5,548,258 | 8/1996 | Kuboyama et al. | 218/22 X |
| 5,569,894 | 10/1996 | Uchida et al. | 218/27 |
| 5,589,672 | 12/1996 | Uchida et al. | 218/34 |
| 5,815,058 | 9/1998 | Gizaw | 218/22 |
| 5,834,724 | 11/1998 | Asakawa et al. | 218/36 |

*Primary Examiner*—J. R. Scott
*Attorney, Agent, or Firm*—Kaensaka & Takeuchi

[57] ABSTRACT

A U-shaped magnetic plate is positioned on the side of a movable contact shoe opposite to a fixed contact shoe, and the tips of the respective legs of the magnetic plate face via a gap the movable contact shoe in a closed condition of the movable contact shoe. A magnetic plate is attached to the surface of the movable contact shoe at the side of the fixed contact, so that the magnetic plates form a closed magnetic circuit surrounding the movable contact shoe. If a high current, such as short circuit current, flows, a magnetic flux passing through the closed magnetic circuit induces an attractive force between the upper end surfaces of the U-shaper magnetic plate and the end surface of the magnetic plate. Accordingly, the movable contact shoe is rapidly opened to quickly interrupt the current, before a signal from an overcurrent trip apparatus operates an opening and closing mechanism. The opening speed of the movable contact shoe is increased when high current flows.

6 Claims, 4 Drawing Sheets

CIRCUIT BREAKER INCLUDING BRIDGING CONTACT WITH MAGNETIC STRUCTURE

BACKGROUND OF THE INVENTION AND RELATED ART STATEMENT

The present invention relates to a circuit breaker used to protect an electric circuit. In particular, it relates to a circuit breaker that increases an opening speed of a movable contact shoe upon high-current interruption.

FIG. 8 is a side view of a current-interrupting section, showing a conventional example of a circuit breaker of this kind. In this figure, a U-shaped fixed contact shoe 1 formed of a flat type conductor and an L-shaped fixed contact shoe 2 are arranged in each phase so as to be positioned opposite to each other, with a fixed contact point 3 being attached to each of the contact shoes. A strip-shaped movable contact shoe 4, whose both ends are bent slightly inwardly, has a pair of movable contact points 5 to contact the fixed contact points 3. When the movable contact shoe 4 is closed as shown in the figure, a contact spring 6 presses the movable contact shoe 4 against the fixed contact shoes 1 and 2 so as to bridge the same. When the movable contact shoe 4 is opened, an opening and closing mechanism (not shown) presses down the contact shoe 4 against the spring force of the contact spring 6.

The fixed contact shoe 1 is connected to a power-side terminal (not shown). The fixed contact shoe 2 is lead to a load-side terminal through an overcurrent trip apparatus (not shown). A pair of arc-extinguishing chambers 7 is located, i.e. one in front and one at the rear of movable contact shoe 4, and a plurality of grids 8 for the chambers 7 surrounds the respective ends of the movable contact shoe 4. The grid 8 comprises a U-shaped magnetic plate, which is supported on side walls 9 made of a laterally disposed pair of insulators. In addition, an arc transition plate 10 made of a high-resistance material, such as steel plate, is provided to extend across the chambers 7, also serving as a supporting plate for the contact spring 6.

As shown by arrows, when a high current flows through the conducting path in FIG. 8, an electromagnetic repulsion force is generated between the parallel conductors of the fixed contact shoes 1 and 2 and the movable contact shoe 4, so that the movable contact shoe 4 is opened to the position indicated by the chain line (two dots) against a contact spring 6. An arc 11 is generated between the contact points 3 and 5. The arc 11 is driven by the grids 8 up to the tips of the fixed contact shoes 1 and 2 and the movable contact shoe 4, and is then extinguished quickly in the arc-extinguishing chambers 7. In this case, if the apparatus has an arc transition plate 10, as shown in the figure, a side leg of the arc 11 at the side of the movable contact shoe 4 moves to the plate 10, and the arc 11 is then extinguished with no current flowing through the movable contact shoe 4, thereby preventing the damage to the contact shoe 4 due to high current.

FIG. 9 is a side view of a conventional example in which an electromagnetic force acting on the movable contact shoe 4 during high current flow is raised further over the electromagnetic force of FIG. 8. That is, in FIG. 9, a pair of U-shaped magnetic plates 12 spaced in the longitudinal direction is located on the side of the movable contact shoe 4 opposite to the fixed contact shoes and the tips of their respective legs sandwich the movable contact shoe 4 in the closed position with a gap from the respective sides. This principle can be explained as follows with reference to FIG. 10. FIG. 10 shows a cross-section taken along line 10—10 in FIG. 9.

In this figure, if a current I flows through the movable contact shoe 4 in the downward direction of this sheet, a magnetic flux Φ based on the current I converges in the magnetic plate 12 and passes clockwise through the movable contact shoe 4 and the magnetic plate 12, as indicated by the chain-line arrow in FIG. 10. At this point, the magnetic flux Φ passes through the movable contact shoe 4 from left to right in FIG. 10 and flows perpendicular to the current I, so that a force is generated in the movable contact shoe 4 in the direction indicated by the solid arrows as a consequence of Fleming's left-hand rule. The movable contact shoe 4 is thus opened and driven at a speed higher than that produced by the electromagnetic resiliency alone in FIG. 8, to thereby improve the interrupting performance.

As described above, an electromagnetic force is conventionally used to drive the movable contact shoe in order to increase the opening speed and improve the circuit breaker performance.

An object of this invention is to make use of a different electromagnetic action to further increase the driving force for the movable contact shoe in order to further improve interrupting performance.

SUMMARY OF THE INVENTION

To attain this object, the invention provides a circuit breaker in which a contact spring urges a movable contact shoe to a fixed contact shoe to maintain the movable contact shoe in a closed position. A magnetic plate is attached to the surface of the movable contact shoe at a side of the fixed contact, while a U-shaped magnetic plate is located at a side of the movable contact shoe opposite to the fixed contact shoe. The tips of the legs of the U-shaped magnetic plate face via a gap the movable contact shoe in the closed condition, so that when a high current, such as a short circuit current, flows through the movable contact shoe, an attractive force is generated in the magnetic plate with the magnetic flux induced by the current, and the movable contact shoe is driven to an opened position against the contact spring.

The action in this invention will be described with reference to FIG. 6. Components corresponding to the conventional example have the same reference numerals as used in FIG. 10. FIG. 6 corresponds to FIG. 10 explaining the action of the conventional example, and is a sectional view taken along line 6—6 in FIG. 1(B). In FIG. 6, a U-shaped magnetic plate or member 12 is located on the side of the movable contact shoe 4 opposite to the fixed contact shoe. The tips of the respective legs of the U-shaped magnetic plate face via a gap the movable contact shoe 4 in the closed condition, and a magnetic plate 13 is attached to the movable contact shoe at a side of the fixed contact shoe. When current I flows through the movable contact shoe 4 in a downward direction in this figure, the magnetic plates 12 and 13 allow a clockwise magnetic flux Φ by current I to converge as indicated in the figure by the chain-line arrow. Thus, an attractive force proportional to the square of the magnetic flux Φ is generated between the upper end surfaces of the magnetic plate 12 and the right and left end surfaces of the magnetic plate 13. Consequently, the movable contact shoe 4 is subjected to a force in the direction indicated by the solid arrow, and is driven to an open position.

This attractive force is stronger than the force which is caused between the current I and the magnetic flux Φ in FIG. 10. In FIG. 6, it has been experimentally confirmed that when a gap x=1.5 mm and a gap y=1 mm, the driving force for the movable contact shoe 4 is up to twice as powerful as that of FIG. 10. This invention is similar to the conventional configuration as shown in FIG. 9 in that the U-shaped magnetic plate 12 is located on the side of movable contact shoe 4 opposite the fixed contact shoe. In principle, however, it differs completely from the configuration illustrated in FIG. 9. The attractive force acts between the magnetic plate 12 and magnetic plate 13 attached to contact the shoe 4 to drive the contact shoe 4.

By joining a magnetic material and a low electric resistance material to form a band-like cladding and by using this cladding material to constitute the movable contact shoe, the circuit breaker can be manufactured more easily than that formed by attaching the magnetic plate to each movable contact shoe.

According to this invention, the movable contact shoe can be made by a magnetic plate instead of attaching the magnetic substance to the movable contact shoe. Although a magnetic material, such as steel plate, provides higher electric resistance than the copper material used for the normal movable contact shoe, such material may still be used, as long as it has relatively low-rated current. Its use helps reducing the material costs.

Furthermore, in case the movable contact shoe is formed as a bridging movable contact shoe extending across a pair of opposed fixed contact shoes, arc-extinguishing chambers are located at the respective ends of the movable contact shoe, and an arc transition plate is installed so as to extend across the arc-extinguishing chambers. Then, the arc transition plate is made by using a magnetic material, and a pair of U-shaped magnetic plates is integrally folded in the arc transition plate so as to oppose the respective ends of the movable contact shoe. According, the number of required parts can be reduced.

DETAILED DESCRIPTION OF PREFERRED EMBODIMENTS

Figure 1A:
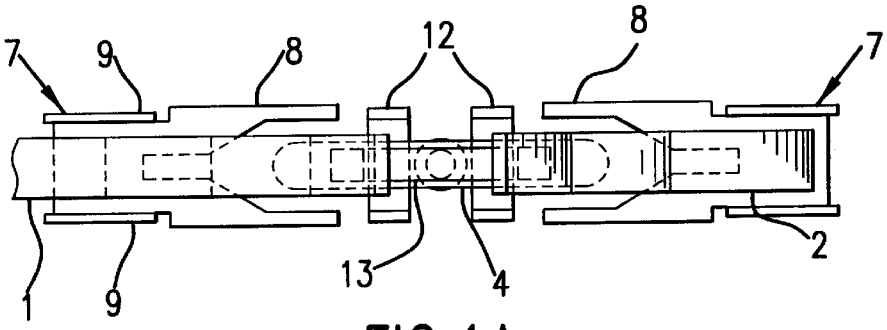
FIG. 1(A) is a top plan view of an embodiment of a current-interrupting section of a circuit breaker.
Figure 1B:
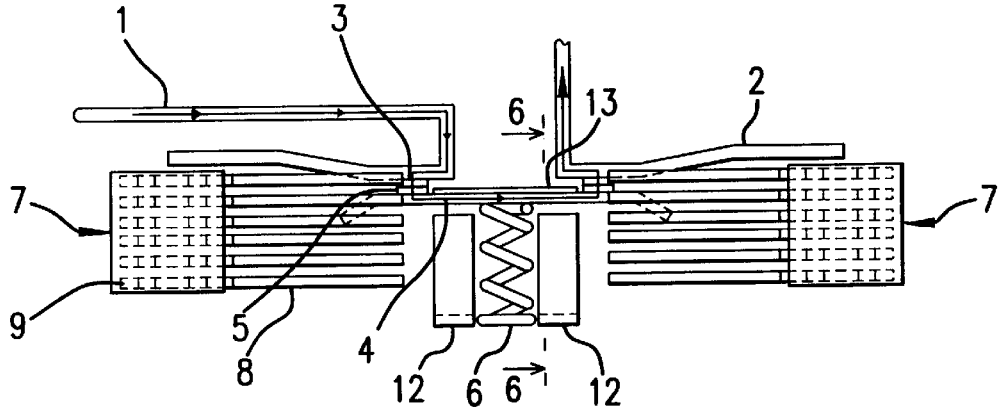
FIG. 1(B) is a side view of the current-interrupting section of FIG. 1(A)
Figure 8:
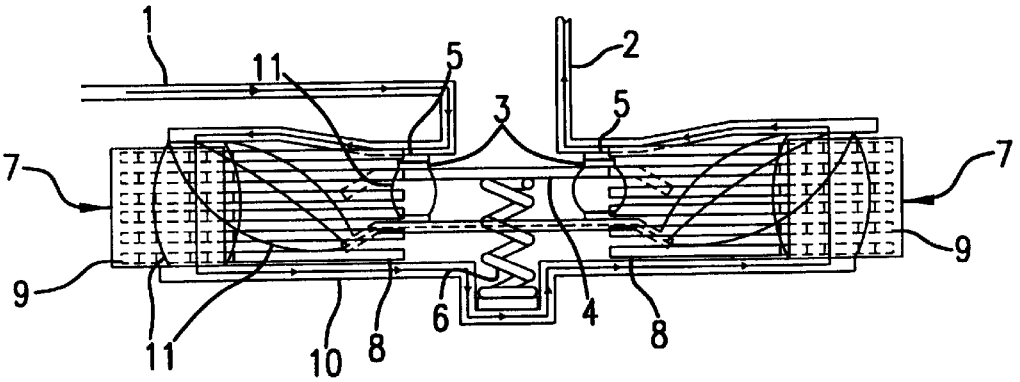
FIG.8 PRIOR ART
FIG. 8 is a side view of a current-interrupting section of a conventional circuit breaker.
Figure 9:
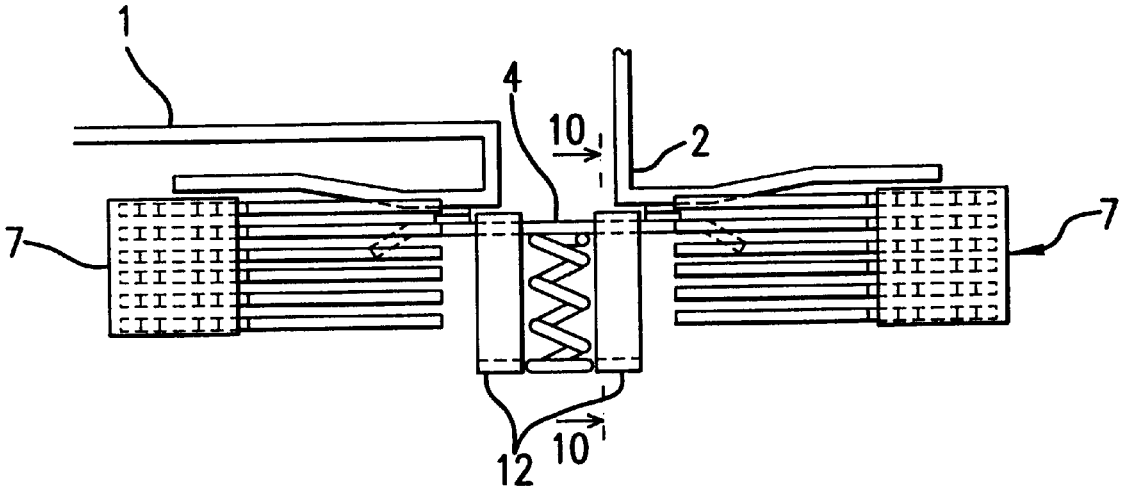
FIG.9 PRIOR ART
FIG. 9 is a side view of a current-interrupting section of a different conventional circuit breaker.
Figure 10:
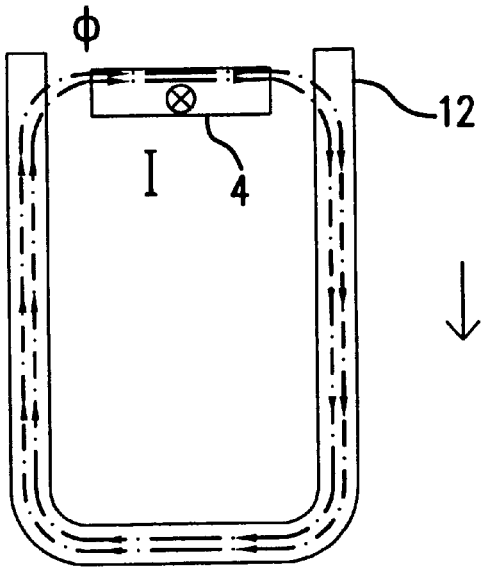
FIG.10 PRIOR ART
FIG. 10 is a sectional view taken along line 10—10 in FIG. 9.

FIG. 1 shows an embodiment of this invention. FIG. 1(A) is a top plan view of a current-interrupting section, and FIG. 1(B) is a side view thereof. The structure of this current-interrupting section is substantially the same as that of the conventional example shown in FIG. 8 or 9, except for portions according to this invention. The portions corresponding to the conventional example have the same reference numerals, and the descriptions of the identical components are omitted. In FIGS. 1(A) and 1(B), a pair of U-shaped magnetic plates or members 12 is located on the side of a movable contact shoe 4 opposite to the fixed contact shoes. The tips of the legs of the magnetic plate are opposed via a gap to the movable contact shoe 4 in the closed condition, as shown in the figure, and a magnetic plate 13 is attached to the movable contact shoe 4 at a side of the fixed contact.

Figure 3A:
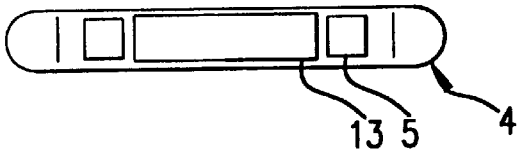
FIG. 3(A) is a top plan view of a movable contact shoe shown in FIGS. 1(A) and 1(B)
Figure 3B:
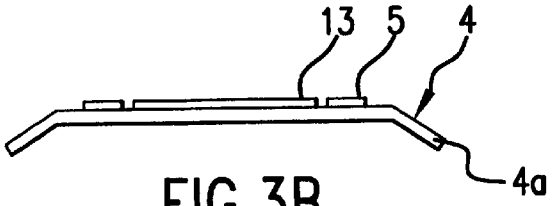
FIG. 3(B) is a side view of the movable contact shoe shown in FIG. 3(A)

FIGS. 3(A) and 3(B) show the movable contact shoe 4 used in

FIGS. 1(A) and 1(B). FIG. 3(A) is a top view, and FIG. 3(B) is a side view. The movable contact shoe 4 is formed by punching a steel plate. Its respective ends 4*a* constituting an arc runner are bent obliquely, and a pair of movable contact points 5 is joined to the movable contact shoe inside the ends by means of brazing. The rectangular magnetic plate 13 formed of a steel plate is attached to the surface of the movable contact shoe 4 at the side of the fixed contact by means of brazing or press-fitting so as to be located between the movable contact points 5.

Figure 6:
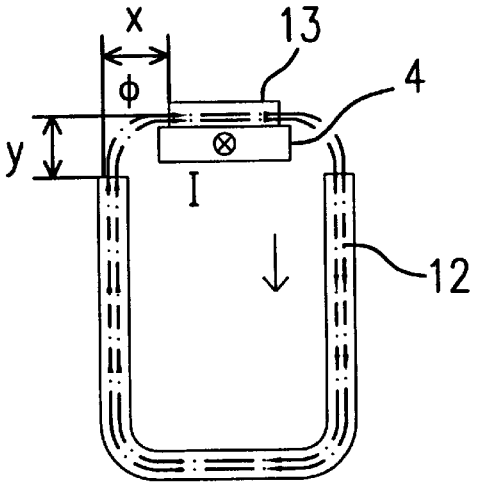
FIG. 6 is a sectional view taken along line 6—6 in FIG. 1(B)

In the current-interrupting section in FIGS. 1(A) and 1(B) having the movable contact shoe 4 as shown in FIGS. 3(A) and 3(B), the magnetic plates 12 and 13 form a closed magnetic circuit surrounding the contact shoe 4. When a high current, such as a short-circuit-current, flows as shown by the arrow in FIG. 1(B), a magnetic flux passing through this circuit induces an attractive force between the upper end surfaces of the magnetic plates 12 and the lateral end surfaces of the magnetic plate 13 in the downward direction in FIG. 1(B), as described in the principle drawing in FIG. 6, to rapidly open the contact shoe 4 to quickly interrupt the current, before a signal from the overcurrent trip apparatus operates an opening and closing mechanism (not shown).

Figure 2A:
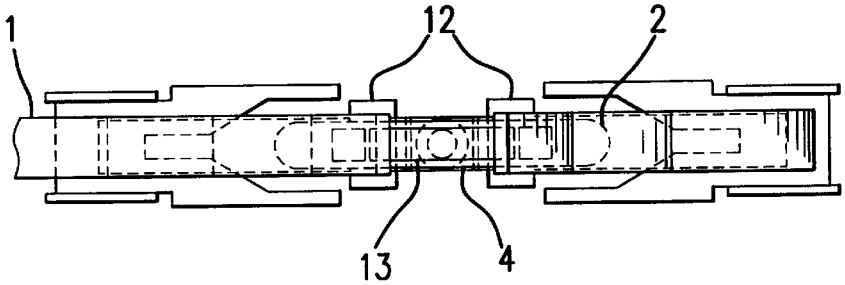
FIG. 2(A) is a top plan view of a different embodiment of a current-interrupting section of a circuit breaker.
Figure 2B:
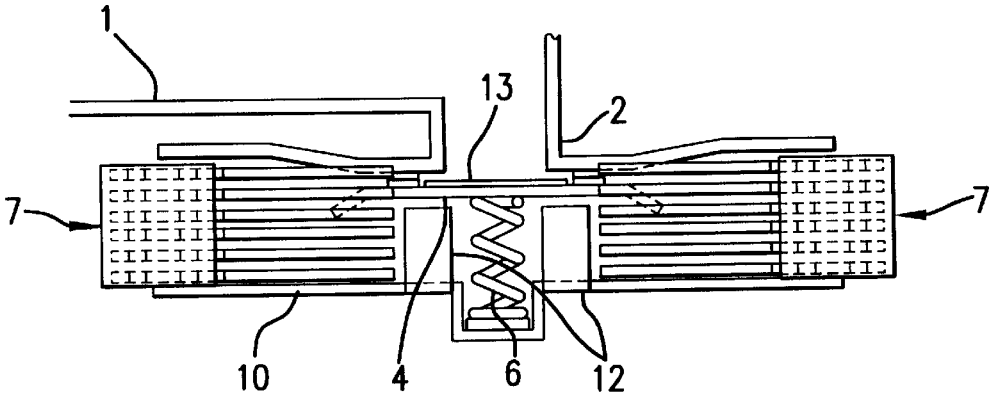
FIG. 2(B) is a side view of the current-interrupting section of FIG. 2(A)

FIGS. 2(A) and 2(B) show an embodiment, in which the magnetic plates 12 are integrated with the arc transition plate 10 formed of a magnetic material, such as steel plate, and arranged so as to extend across the arc-extinguishing chambers 7. This configuration can improve the interrupting performance without increasing the number of required parts.

Figure 4A:
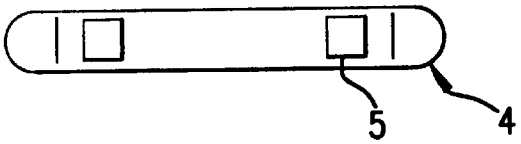
FIG. 4(A) is a top plan view of a different embodiment of a movable contact shoe.
Figure 4B:
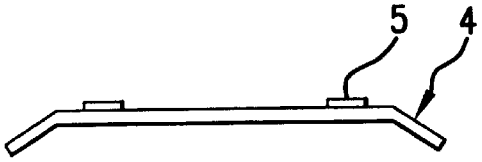
FIG. 4(B) is a side view of the movable contact shoe shown in FIG. 4(A)

FIGS. 4(A) and 4(B) show an embodiment in which a movable contact shoe 4 is composed of a magnetic material instead of attaching the magnetic plate to the movable contact shoe 4. In this case, the contact shoe 4 is wholly formed by punching a magnetic material, such as steel plate. This embodiment is suitable for circuit breakers having a relatively low-rated current, and the material costs are reduced.

Figure 5A:
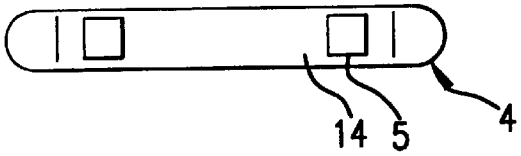
FIG. 5(A) is a top plan view of a yet another embodiment of a movable contact shoe.
Figure 5B:
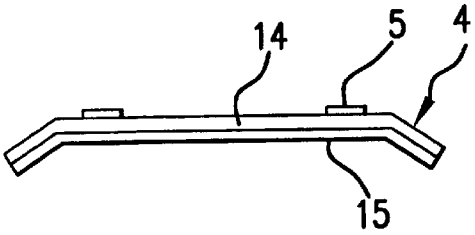
FIG. 5(B) is a side view of the movable contact shoe shown in FIG. 5(A)

FIGS. 5(A) and 5(B) show an embodiment, in which the contact shoe 4 is composed of a band-like cladding formed by joining a magnetic material 14, such as steel plate, and a low electric resistance material 15, such as copper plate. The magnetic material 14 and low electric resistance material 15 are joined by contact bonding or by brazing. This configuration increases the current carrying capacity of the movable contact shoe 4 while reducing the number of required parts.

Figure 7:
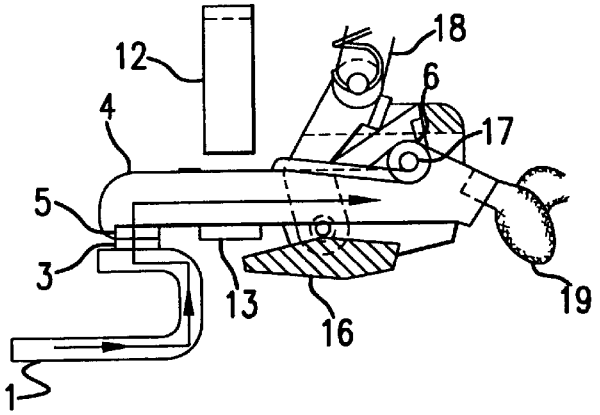
FIG. 7 is a side view of a current-interrupting section of a circuit breaker, showing yet another embodiment of this invention.

FIG. 7 shows an embodiment of a circuit breaker having a rotating type movable contact shoe 4. The contact shoe 4 is held on an insulating holder 16 via a pin 17 to permit rotation, and is urged in the counterclockwise direction in FIG. 7 by a contact spring 6 formed of a torsion spring. The holder 16 is supported on a body case of the circuit breaker via an open and close shaft (not shown) integrated with the holder to permit rotation, allowing an open and close mechanism 18 to open and close the holder 16. The contact shoe 4 is lead to a load-side terminal (not shown) through an overcurrent trip apparatus (not shown) connected via a lead wire 19.

The fixed contact shoe 1 integrated with a power-side terminal (not shown) has a fixed contact point 3 attached to its end folded back in a U-shape. The fixed contact point 3 contacts the movable contact point 5 at the tip of the contact shoe 4. A U-shaped magnetic plate or member 12 is located on the side of the movable contact shoe 4 opposite to the fixed contact shoe, and the tips of the respective legs of the magnetic plate 12 face via a gap the contact shoe 4 in a closed condition, shown in the figure. A magnetic plate 13 is attached to the surface of the contact shoe 4 at the side of the fixed contact shoe.

In FIG. 7, when a high current, such as short circuit current, occurs as indicated by an arrow, a magnetic flux passing through a closed magnetic circuit formed of the magnetic plates 12 and 13 induces an attractive force between the upper end surfaces of the magnetic plates 12 and the lateral end surfaces of the magnetic plate 13. Accordingly, the contact shoe 4 is rotated clockwise around the pin 17 to quickly interrupt a current, before the opening and closing mechanism 18 operates.

According to this invention, the closed magnetic circuit surrounding the movable contact shoe is formed by the U-shaped magnetic plate located on the side of the movable contact shoe opposite to the fixed contact shoe and the magnetic plate attached to the surface of the movable contact shoe on the side of the fixed contact shoe. When a high current, such as short circuit current flows through the movable contact shoe, an attractive force is generated between the magnetic plates as a result of the current's magnetic flux to open the movable contact shoe. This configuration increases the opening speed of the movable contact shoe, providing excellent interrupting performance.

What is claimed is:

1. A circuit breaker, comprising:

at least one fixed contact shoe, a movable contact shoe movably arranged to the at least one fixed contact shoe, a contact spring attached to the movable contact shoe to urge the movable contact shoe to the fixed contact shoe to maintain the movable contact shoe in a closed position, a planar magnetic material attached to a surface of the movable contact at a side of the fixed contact, and at least one U-shaped magnetic member located at a side of the movable contact shoe opposite to the fixed contact shoe, said magnetic substance having legs with tips and being arranged such that the tips face via a gap the movable contact shoe in a closed condition of the movable contact shoe so that when a high current flows through the movable contact shoe, an attractive force is generated in the magnetic member by the magnetic flux induced by the current to thereby drive the movable contact shoe to an open position against the contact spring.

2. A circuit breaker according to claim 1, wherein said movable contact shoe is formed of a cladding material including a magnetic material and a low electric resistance material joined together.

3. A circuit breaker according to claim 1, wherein said movable contact shoe is disposed between two fixed contact shoes and includes two contacts thereon, said magnetic material being disposed on the movable contact shoe between the two contacts.

4. A circuit breaker according to claim 3, wherein two U-shaped magnetic members are located near the two contacts of the movable contact shoe, respectively.

5. A circuit breaker according to claim 1, wherein said movable contact shoe is disposed as a bridging movable contact shoe between two fixed contact shoes at a side opposite to the movable contact shoe; said circuit breaker further comprises arc-extinguishing chambers located at respective ends of the movable contact shoe, and an arc-transition plate formed of a magnetic material and installed between the arc-extinguishing chambers to extend therebetween; and two U-shaped magnetic members are integrally formed with the arc transition plate and disposed to face respective ends of the movable contact shoe.

6. A circuit breaker comprising:

a fixed contact shoe, a movable contact shoe movably arranged to the fixed contact shoe and being made of a magnetic material, a contact spring attached to the movable contact shoe to urge the movable contact shoe to the fixed contact shoe to maintain the movable contact shoe in a closed position, a U-shaped magnetic member located on a side of the movable contact shoe opposite to the fixed contact shoe, said magnetic member having legs with tips and being arranged such that the tips face the movable contact shoe via a gap in a closed condition of the movable contact shoe so that when a high current flows through the movable contact shoe, an attractive force is generated between the magnetic member and the movable contact shoe by a magnetic flux induced by the current to thereby drive the movable contact shoe to an open position against the contact spring.

* * * * *

UNITED STATES PATENT AND TRADEMARK OFFICE

CERTIFICATE OF CORRECTION

PATENT NO : 6,103,986

DATED : August 15, 2000

INVENTOR(S) : Koji Asakawa; Takumi Fujihira; Naoshi Uchida; Katsunori Kuboyama; Tatsunori Takahashi; Kentaro Toyama It is certified that error appears in the above-identified patent and that said Letters Patent are hereby corrected as shown below:

In column 1, line 62, after "shoes" add --comma--;

In column 3, line 4, after "opposite" add --to--;

line 32, change "According" to --Accordingly--;

In column 4, line 20, delete the blank after "in";

line 21, move "FIGS. 1(A) ...." to right after "in" on line 20; and

In column 6, line 3, change "substance" to --member--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*